United States Patent [19]

Sterne et al.

[11] Patent Number: 4,917,367

[45] Date of Patent: Apr. 17, 1990

[54] ON-LINE TIPPING APPARATUS FOR A SIGNATURE INSERTING MACHINE

[76] Inventors: Harold E. Sterne, 5815 Cherokee Dr., Cincinnati, Ohio 45243; Anthony V. Macke, 1879 U.S. Rte. 52, Moscow, Ohio 45153

[21] Appl. No.: 237,542

[22] Filed: Aug. 29, 1988

[51] Int. Cl.[4] ..... B65H 5/30

[52] U.S. Cl. ..... 270/57; 270/54; 270/55

[58] Field of Search ..... 270/37, 53, 54, 55, 270/56, 57, 58

[56] References Cited

U.S. PATENT DOCUMENTS

| | | | |
|---|---|---|---|
| Re. 31,710 | 10/1984 | Jackson | 270/57 |
| 3,162,434 | 12/1964 | Hepp | 270/57 |
| 3,371,924 | 3/1968 | Nelson et al. | 270/53 |
| 3,630,513 | 12/1971 | Davidson et al. | 270/53 |
| 3,658,318 | 4/1972 | Bunting et al. | 270/55 |
| 3,663,007 | 5/1972 | Preiter | 270/55 |
| 4,083,551 | 4/1978 | St. Denis | 270/55 |

OTHER PUBLICATIONS

Harris Saddle Stitch Binding Systems, Harris Corporation p. 22, 2-22-83.

Müller Martini Brochure, p. 26, May 1986.

*Primary Examiner*—Carl D. Price

*Assistant Examiner*—Therese M. Newholm

*Attorney, Agent, or Firm*—Charles R. Wilson

[57] ABSTRACT

A portable on-line tipping apparatus is intended for use with a signature inserting machine. The apparatus comprises (a) a frame assembly, (b) a drive system base mounted on the frame assembly which is capable of vertical adjustment, (c) an auxiliary chain drive system mounted on the base, (d) a raceway on the frame assembly for receiving a signature from a hopper of the signature inserting machine, (e) an adhesive applying mechanism on the frame assembly for directing a bead of adhesive to a signature, and (f) an elongated catch saddle positioned on above the raceway for properly positioning an insert so as to overlie the adhesive bead. The auxiliary chain drive system of the on-line tipping apparatus is driven by the main conveyor chain drive system of the signature inserting machine to ensure proper insert placement.

19 Claims, 8 Drawing Sheets

ON-LINE TIPPING APPARATUS FOR A SIGNATURE INSERTING MACHINE

This invention relates to an on-line tipping apparatus for use with a signature inserting machine. More particularly, the invention relates to an on-line tipping apparatus which has a slave drive system run by the main conveyor chain drive system of the signature inserting machine.

BACKGROUND OF THE INVENTION

Booklets such as magazines, manuals and catalogs are assembled on a commercial scale by automated systems. Typically, sections of the booklet are assembled and bound by one machine. Each section consists of two or more sheets and is commonly referred to in the industry as a signature.

One widely used machine for collating signatures is a signature inserter. A signature inserting machine includes a series of hoppers positioned side by side above a conveyor chain. The hoppers contain signatures. They are generally continually hand loaded or machine loaded throughout a run. In one type of signature inserting machine, a stationary member known as a saddle is positioned above portions of the conveyor chain and adjacent each hopper. The saddles are formed in a generally inverted V shape for receiving partially opened signatures from its associated hopper. The conveyor chain also includes several signature engaging pusher pins which are moved in sequence past the saddles to engage a signature and push it along. As a signature is picked from a saddle by the pusher pins of the conveyor chain, that signature is deposited on top of other signatures previously picked from saddles and being moved by the same pusher pin of the conveyor chain.

A typical saddle machine has at least four hoppers which contain the signatures to be assembled. After the last signature, usually the front and back cover pages, is deposited onto previous signatures, the assembled booklet passes through a station which permanently binds it. Stapling or stitching are two examples of binding steps for booklets. Thereafter, the booklet is transferred to a trimming machine that trims its top, bottom and front edges.

It is a fairly common practice to adhesively attach or tip an insert to an outside page of one of the signatures. The inserts usually differ in size than a signature page and therefor are conspicuous. They are typically used for an advertising or other related purpose.

The industry has used various types of machines for adding or, as commonly used, tipping an insert to a signature page. In one method of tipping, a separate machine is utilized to tip i.e., glue an insert to a page of a signature. Thus, the signatures are transported to the tipping machine for the sole purpose of adding an insert. Thereafter the signatures are taken to the signature inserting machine and the signatures completely assembled to form the booklet.

Some signature inserting machines have been disclosed having a means built into them as an integral part for the purpose of adding an insert. U.S. Pat. Nos. 3,371,924, 3,658,318 and 4,083,551 contain descriptions of such machines. The machines operate in the same basic fashion. A supply of inserts to be attached to the signatures is placed in a feed hopper. The insert is individually placed onto an adhesive bearing signature being moved by a conveyor chain. The adhesive is applied along one edge of the insert or one edge of the signature to be bound. An apparent problem with some such inserting machines having the insert tipping capability as an integral part is that they are either slow or inflexible in the size of inserts which they can handle.

There is a need for an apparatus for the tipping of inserts as a part of the operation of the signature inserting machine. The apparatus must be flexible enough to be operable with different makes of signature inserting machines. Additionally, the apparatus must be able to properly apply the inserts in a precise location. Most importantly, the apparatus must be capable of being adjusted so as to be in perfect timing with the conveyor chain of the inserting machine. There has now been developed an on-line tipping apparatus which is portable in nature and provides the features which are required.

SUMMARY OF THE INVENTION

An on-line tipping apparatus is intended for use with a signature inserting machine. The apparatus is portable in that it is adapted to be moved into operable association with a conventional signature inserting machine when needed. The apparatus has an auxiliary chain drive system which is run by a main conveyor chain drive system of the signature inserting machine. The on-line tipping apparatus comprises a frame assembly which is capable of being readily moved. A base mounted on the frame assembly accommodates the auxiliary chain drive system. The base is capable of vertical movement for approximate positioning of the auxiliary chain drive system with the main conveyor chain drive system of the signature inserting machine. Associated with the frame assembly is a raceway with elongated flat saddles. An adhesive applying mechanism is also operably associated with the frame assembly for directing a bead of adhesive to a signature as it passes along the raceway. The elongated flat saddles positioned above the raceway receives an insert in a proper position for adhering to the signature. The auxiliary chain drive system comprises an endless conveyor chain which has adjustable timed connection means with the main conveyor chain for ensuring the insert is properly positioned when adhered to the signature.

DETAILED DESCRIPTION OF THE INVENTION

Figure 1:
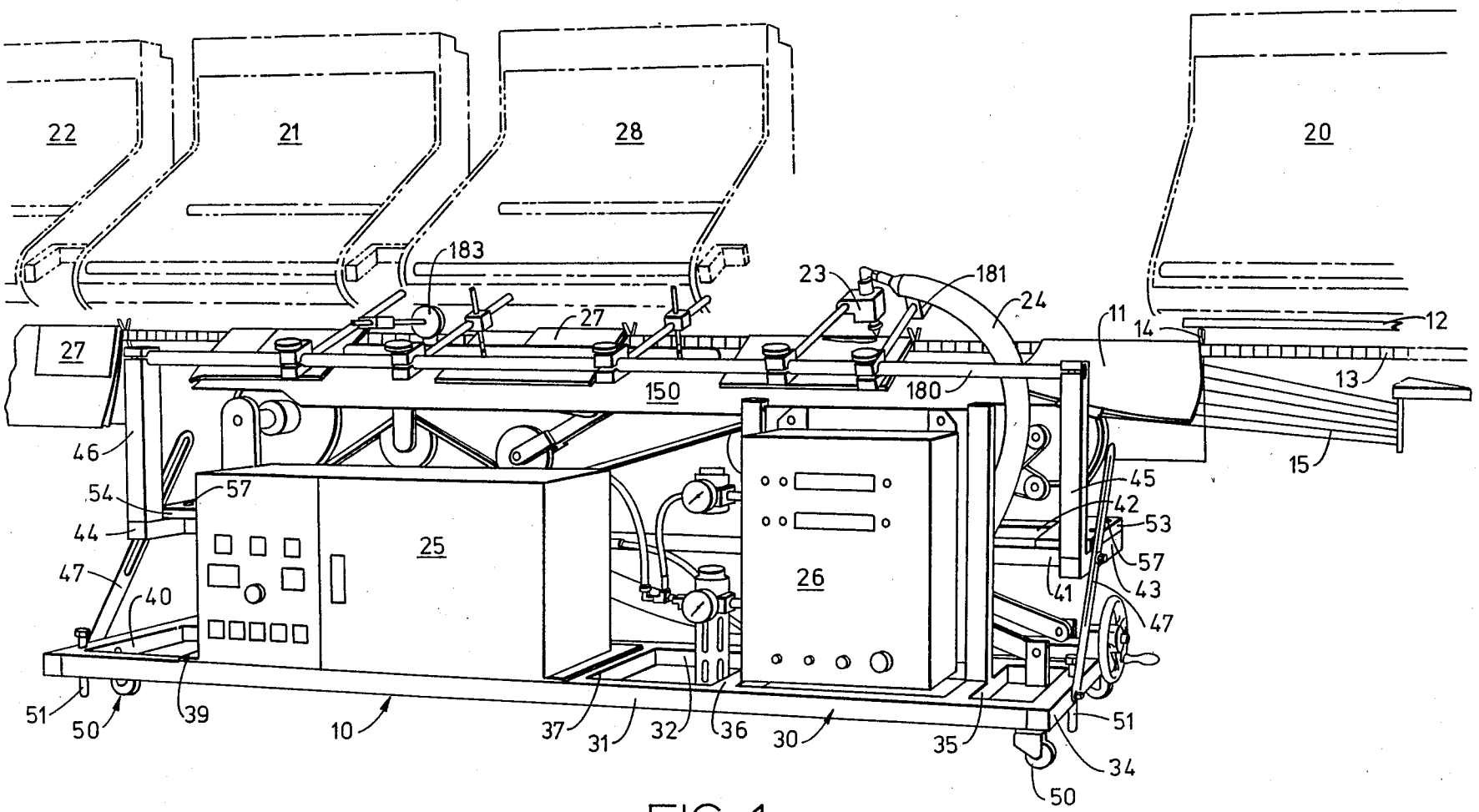
FIG. 1 is a view in perspective of a portable on-line tipping apparatus in operable association with a signature inserting machine.

The development of this invention is described with particular reference to the drawings. FIG. 1 shows the on-line tipping apparatus when operably connected to a typical signature inserting machine. Booklets such as magazines, manuals, catalogues and brochures are assembled and have added thereto one or more inserts by the apparatus of this invention. The inserts added can contain multiple pages and virtually be any size or shape. A magazine is depicted in the process of being assembled wherein one page of a signature has a single sheet insert adhered thereto. The description which follows describes the apparatus of this invention when used for this purpose. FIGS. 2–11 disclose the on-line tipping apparatus when removed from the signature inserting machine.

The on-line tipping apparatus of this invention, generally 10 in FIG. 1, is shown in operable association with a signature inserting machine. The signature inserting machine shown is typical of such machines. A signature 11 is picked from a saddle 12 and positioned in a generally inverted V orientation on a moving main conveyor chain 13. The chain 13 is an endless conveyor chain driven by a power source and guided by sprocket wheels (not shown) to travel in a longitudinal path the length of the signature inserting machine. Pusher pins 14 on the conveyor chain engage a deposited signature on the saddle and drive it along. Guide wires 15 extending outwardly from the conveyor chain guide to a center of the booklet forces a half-section of the booklet as assembled at that point towards a horizontal position to ride onto a raceway of the on-line tipping apparatus.

Signature hoppers 20, 21 and 22 each contains a supply of folded signatures. A signature extractor means (not shown) is provided on each hopper to remove a single signature from a hopper and deposit it on the saddle 12 over conveyor chain 13. The pusher pin 14 picks the signature off the saddle causes it to drop onto conveyor chain 13. Each succeeding signature is deposited on top of assembled signatures moving along the conveyor chain 13. Generally, the signatures are loaded in the hoppers in an on-edge or flat condition with a folded edge lowermost. Several hoppers on the machine are provided, one for each additional signature. Obviously, the signatures are placed in the successive hoppers in a sequence which results in a magazine in proper order. The last hopper contains a signature which represents the front and back cover pages of the booklet. The assembled or inserted signatures taken from the conveyor chain after the last hopper are stitched, stapled or otherwise bound, trimmed in-line, and packaged for delivery.

The foregoing description relates to well known aspects of a typical signature inserting machines. The particular details of the foregoing elements and the manner in which those elements are operated in timed relation to each other to deposit signatures from the hopper onto the saddle and then the conveyor chain will be readily apparent to those familiar with the art. Further explanation and details are found in U.S. Pat. Nos. 3,087,721, 3,311,368, and 3,663,007, the disclosures of which are herein incorporated by reference.

As evident from FIG. 1, a hopper typically positioned between hoppers 20 and 28 is removed to accommodate the on-line tipping apparatus of this invention. Additionally, a portion of a chain carrier which supports the main conveyor chain 13 is removed to receive the take-off drive system of the on-line tipping apparatus, as explained in further detail below. As shown generally, a glue gun 23 applies a bead of adhesive to a signature page. The glue gun is fed by hose 24 leading from hot melt adhesive reservoir 25 in a controlled fashion by operation of control box 26. An insert 27 from hopper 28 is properly positioned over a page of the signature with the adhesive bead and adhered thereto. Additional signatures are fed onto the saddles associated with conveyor chain 13 from hoppers 21, 22 and subsequent hoppers (not shown).

Figure 2:
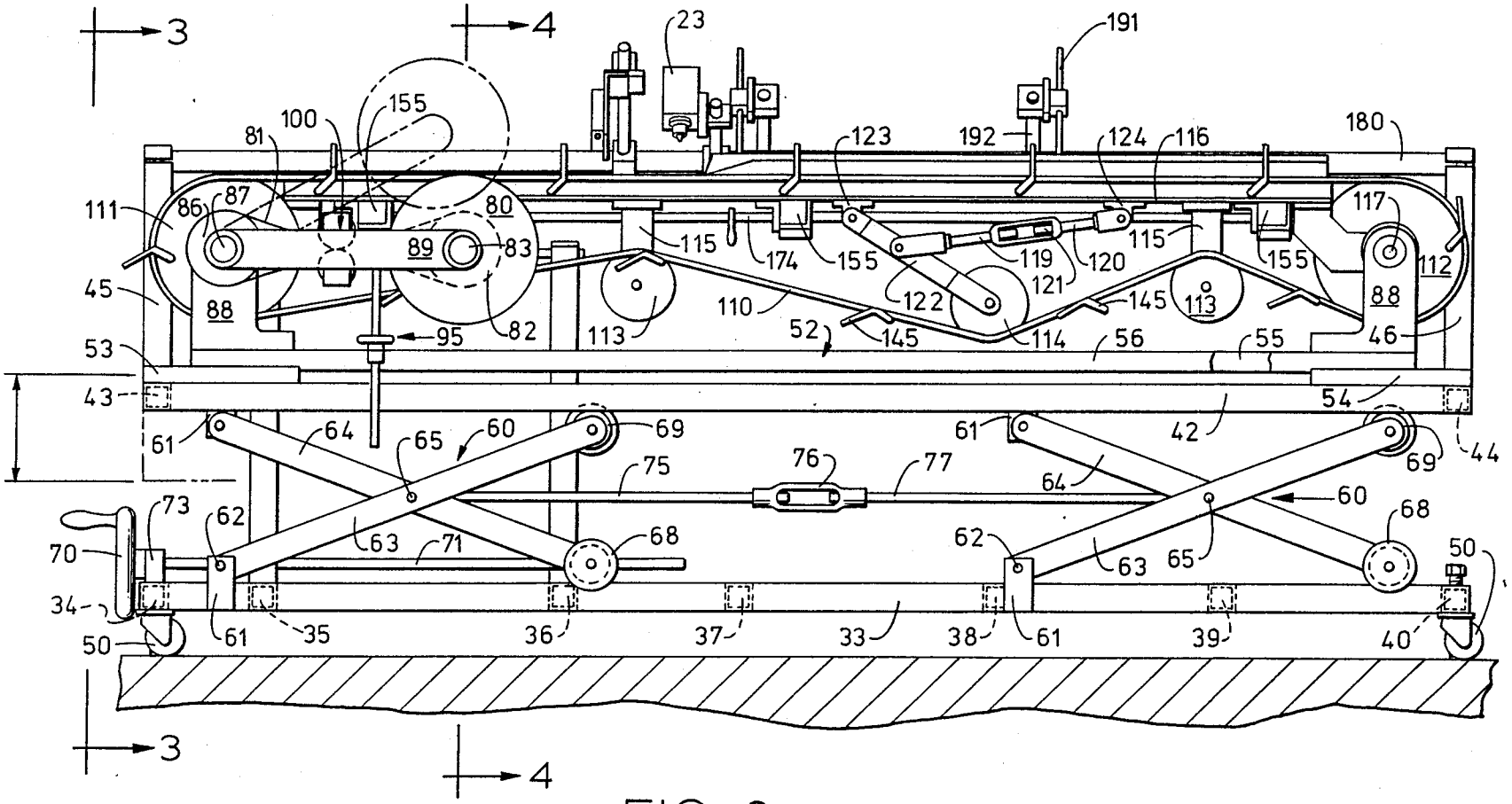
FIG. 2 is a side view of the portable on-line tipping apparatus of this invention.
Figure 3:
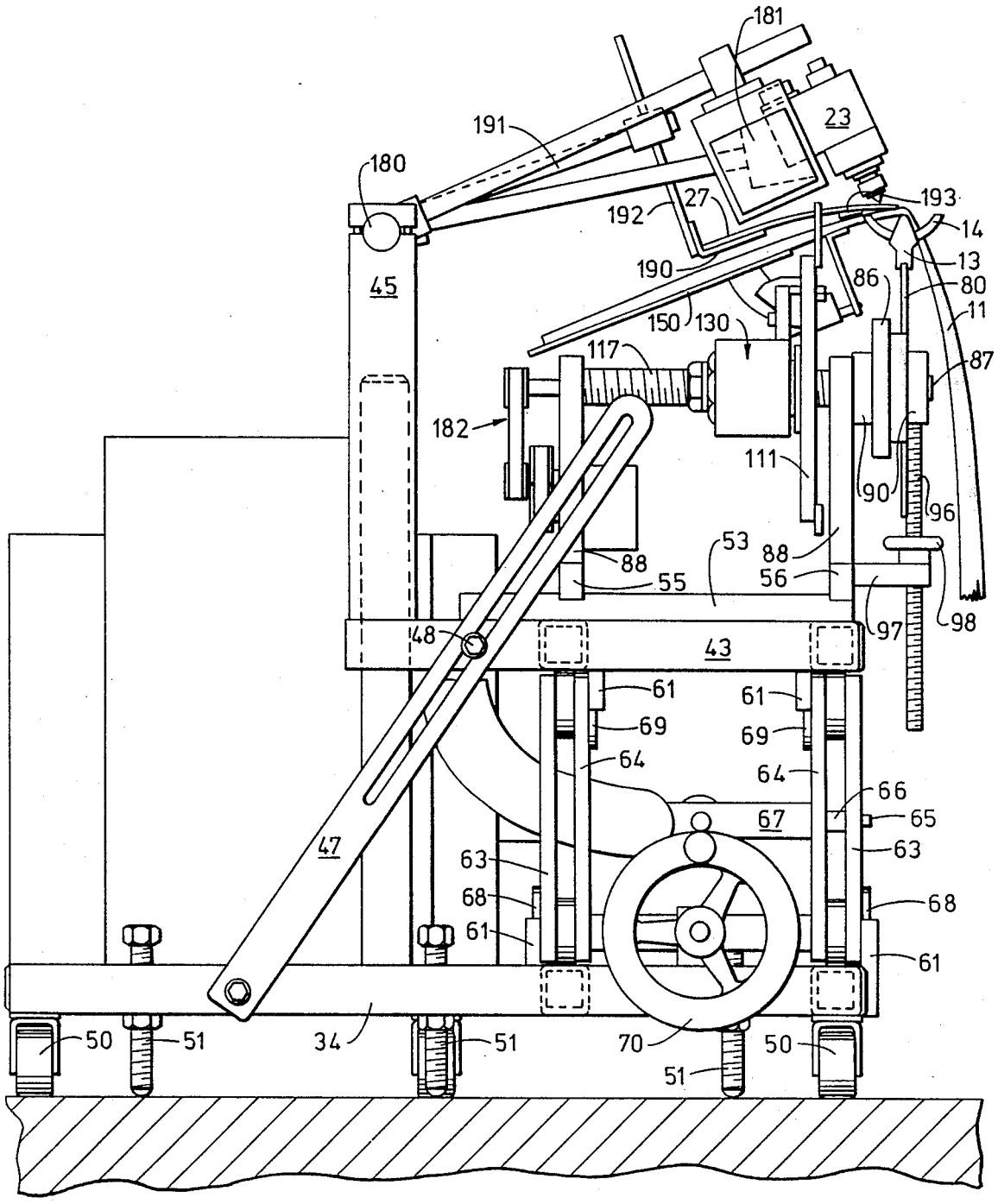
FIG. 3 is an end view of the portable on-line tipping apparatus of FIG. 2.
Figure 4:
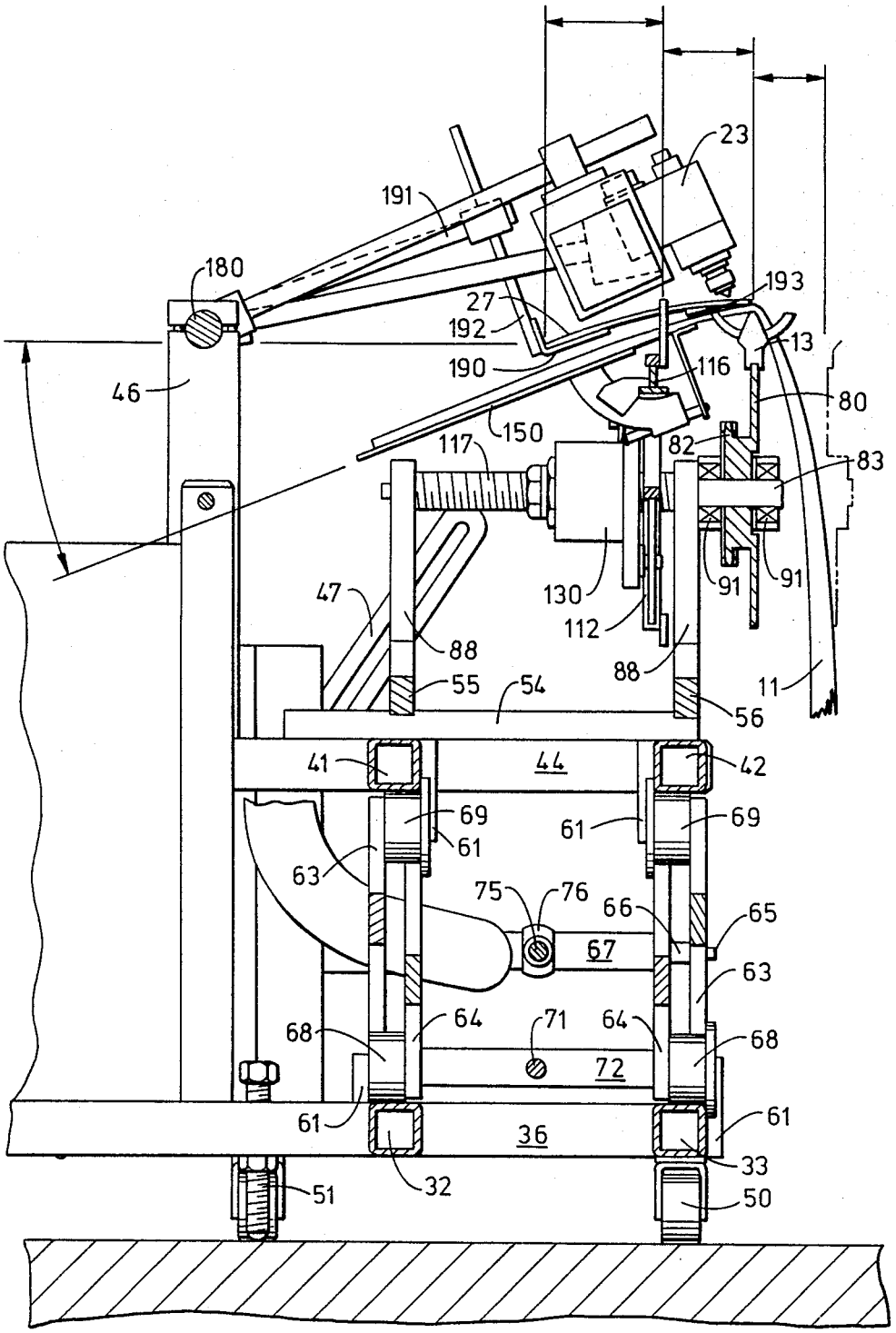
FIG. 4 is a sectional end view of the on-line tipping apparatus of FIG. 2 taken along line 4—4.

The on-line tipper apparatus shown in FIG. 1 and in greater detail in FIGS. 2–4 is portable in nature. That is, it can be stored in a remote location when not need, but readily moved and connected to a conventional signature inserting machine when needed. The apparatus is usable with several models of signature inserting machines made by different manufacturers because of various adjusting mechanisms built into the apparatus.

With reference to FIGS. 1–4, the apparatus comprises a frame assembly 30 with caster wheels mounted at each of the lower four corners of the frame assembly. The frame assembly serves the function of providing a base to which the various components of the apparatus are mounted. It comprises longitudinal base members 31, 32 and 33, lower cross bars 34, 35, 36, 37, 38, 39 and 40, longitudinal upper members 41 and 42, upper cross bars 43 and 44, and vertical support members 45 and 46. The frame members, preferably made from hollow structural tubing, are attached e.g., by weldments or bolts and nuts to one another to form a unitary structure of sufficient strength for its intended function. Slotted braces 47 are pivotably attached to cross bars 34 and 40 at a lower extremity and adjustably attached to cross bars 43 and 44 near an upper extremity. The braces allow the upper members of the frame assembly to be vertically adjusted according to need, yet provide a degree of stability when bolt heads 48 are forced into engagement with the slot edges.

Caster wheels 50 are mounted on the frame assembly at each of the frame assembly corners. Other wheel means can readily be used. An anchor bolt 51 is positioned in at least one lower member of the frame assembly so as to engage the floor surface upon tightening. This anchors or secures the apparatus once it is initially positioned. Other securing means such as roller blocks, etc. can as well be used.

A drive system base 52 is mounted on the upper members 41 and 42 and upper cross bars 43 and 44 of the frame assembly. The drive system base is comprised of plates 53 and 54 at each end of the longitudinal upper members and upper cross bars together with connecting rails 55 and 56 extending between the plates. The base is provided to accommodate an auxiliary chain drive system. A series of bolt holes 57 near the outside edges of the plates allows some lateral positioning of the base relative to the frame assembly depending on the particular signature inserting machine which is being used.

The drive system base 52 is also capable of vertical movement relative to the base members of the frame assembly. The vertical movement feature is used for the purpose of approximate positioning of the auxiliary chain drive system with the main conveyor chain drive system of the signature inserting machine. Scissor lifter means 60 at each end of the platform are provided for the vertical movement. There are two sets of scissor lifter bars at each end of the base for a total of four scissor lifters. Lower arm pivot brackets 61 are secured to longitudinal base members 32 and 33. Pivot pin 62 holds one end of each lifter bar 63 in pivotable engagement. Upper arm pivot brackets 61 positioned on the longitudinal upper members 41 and 42 substantially directly above lower arm pivot brackets 61 are used to hold each lifter bar 64 in pivotable engagement. A shoulder bolt 65 in the center of lifter bars 63 and 64 holds the two bars together in a scissors fashion. A second shoulder bolt 65 on the backside of the apparatus on the same end also holds together the second set of lifter bars. Spacers 66 and spacer bar 67 receives each shoulder bolt. Rollers 68 and 69 at the non-pivot ends of the lifter bars ride along base members 31 and 32 and longitudinal upper members 41 ad 42, respectively.

Crank wheel 70 is connected to the scissor lifter means 60 by screw member 71 and brawl bar 72. Screw member 71 extends through bearing block 73 and is threaded into brawl bar 72. In turn, the brawl bar 72 is secured to both rollers 68. Turning the crank wheel 70 will cause the screw member 71 to draw the brawl bar 72 towards or away from the wheel depending on the direction turned. In effect, the ends of the lifter bars 64 are caused to laterally move which causes the cooperatively acting part of the scissor means, i.e., lifter bar 63 to raise or lower. Motion from the two sets of lifter bars adjacent the crankwheel is transferred to the opposite sets of lifter bars by means of left hand screw member 75, turnbuckle 76, and right hand screw member 77. The outer extremity of each of these screws is attached to spacer bars 67. As such, turning of the crank wheel 70 causes all four sets of scissor lifter bars to substantially simultaneously operate.

Mounted on drive system base 52 is an auxiliary chain drive system. The system comprises a power take-off assembly and an endless auxiliary conveyor chain assembly. The power take-off assembly is capable of transferring power from the main conveyor chain of the signature inserting machine to the auxiliary conveyor chain. Adjusting means as described in following paragraphs are built into the assemblies to ensure that the drive systems are synchronized and that pusher pins on the main conveyor chain and the auxiliary conveyor chain are compatible.

The power take-off assembly uses a take-off sprocket wheel 80, an endless transfer chain 81, and a power transfer wheel 82 to transmit power to the auxiliary conveyor chain assembly. Take-off sprocket wheel 80 and power transfer wheel 82 are fixed together and each mounted on shaft 83 along with bearings. The transfer chain 81 which is driven by wheel 82 transfers power to drive wheel 86. Shaft 87 with drive wheel 86 is mounted on pylons 88.

Figure 5:
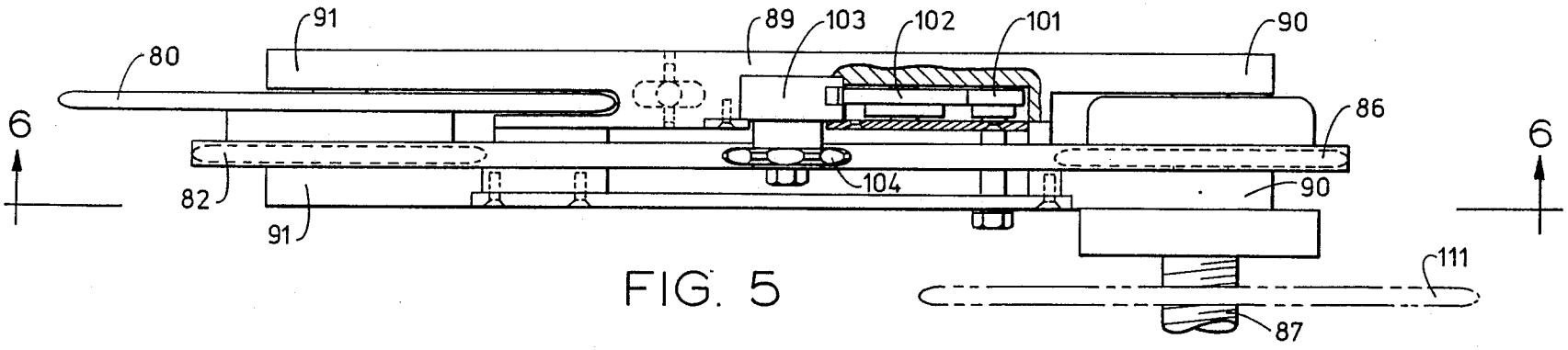
FIG. 5 is a top view of the power take-off assembly of the on-line tipping apparatus of FIG. 2.

A pivot m 89 is used to adjustably position the take-off sprocket wheel 80 and power transfer wheel 82. As best seen in FIGS. 2, 3 and 5, the pivot arm 89 has a first set of ears 90 which are pivotably mounted on shaft 87. The other end of the pivot arm has a second set of ears 91 adapted to hold shaft 83, along with the take-off sprocket wheel 80 and power transfer wheel 82 mounted thereon. A height adjusting mechanism 95 is operably connected to the pivot arm 89 to move it about its pivot point relative to the drive system base 52. This allows the take-off sprocket wheel 80 to properly mesh with the main conveyor chain. Thus, the scissor lifter bars are used for approximate positioning of the take-off sprocket wheel and the adjusting mechanism 95 is used to cause the teeth of the sprocket wheel to mesh with the links of the main conveyor chain.

Adjusting mechanism 95 comprises a turn screw 96 in operable engagement at one end with pivot arm 89. The turn screw extends through bracket 97 which in turn is attached to the base 52. Internally threaded turn knob 98 is positioned on the turn screw and in engagement with bracket 97. Adjusting of the turn knob 98 causes the pivot arm 89 to move up or down about its pivot point. This allows take-off sprocket wheel 80 to be engaged or disengaged from the main conveyor chain of the signature inserting machine. FIG. 2 shows take-off sprocket wheel 80 in a fully raised position in dotted lines.

Figure 6:
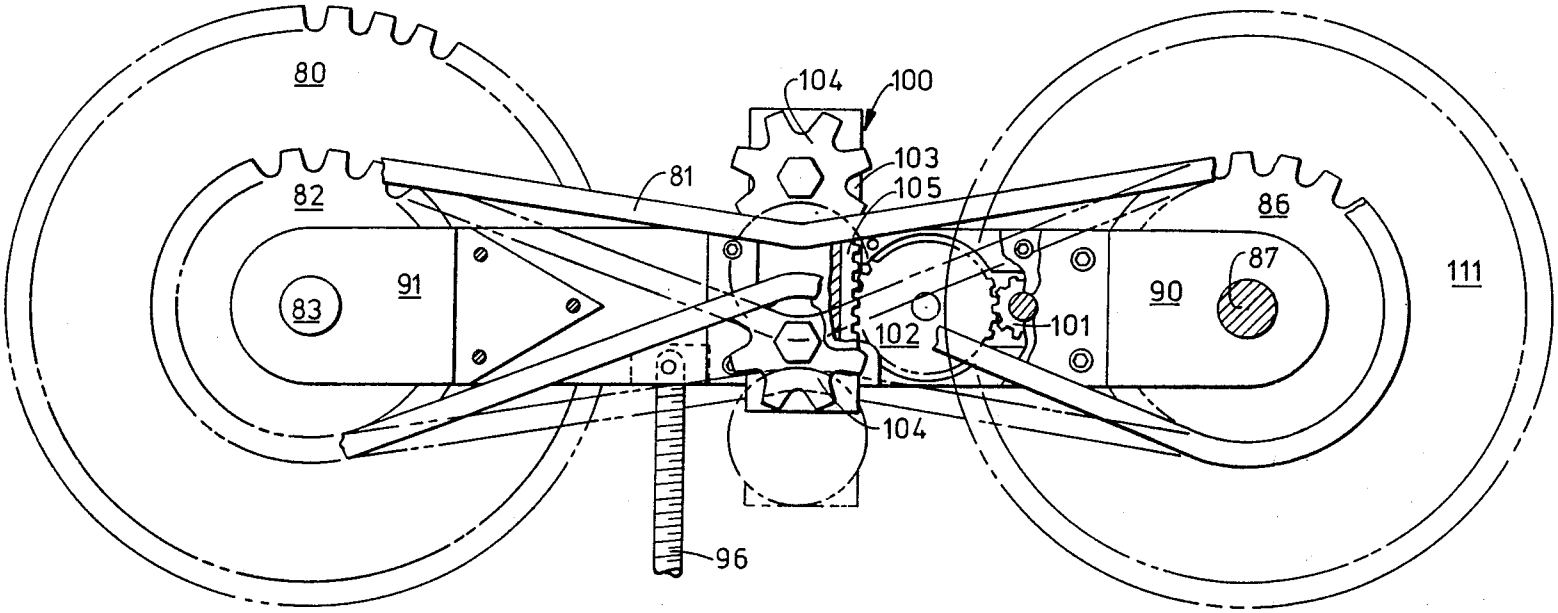
FIG. 6 is a side view taken along line 6—6 of FIG. 5 showing in detail the slide block synchronization assembly used with the power take-off assembly.

A slide block synchronization assembly 100 is also provided to advance transfer chain 81 a fraction of a chain link if needed. As best seen in FIG. 6, the assembly comprises an adjusting wheel 101, idle wheel 102, slide block 103 and sprocket wheels 104. The slide block has a gear rack 105 to receive gear teeth of the idle wheel. Movement of the adjusting wheel 101 causes slide block 103 with sprocket wheels 104 mounted thereon to move up or down. This in turn causes the sprocket wheel 104 to change its point of engagement with transfer chain 81.

The endless auxiliary conveyor chain assembly comprises an endless conveyor chain 110 with sprocket wheels 111 and 112, idle wheels 113 and adjusting idle wheel 114. Each sprocket wheel revolves about a threaded shaft 117. The shafts are mounted above the drive system base by means of the pylons 88. Idle wheels 113 are mounted on hanging brackets 115 which are attached to rail 116. Rail 116 extends between sprocket wheels 111 and 112.

Adjusting idle wheel 114 is mounted for adjustable movement to accommodate different sized conveyor chains and chain stretching which may occur. The adjustment means comprises left hand screw member 119, right hand screw member 120 and turnbuckle 121. Tension bar 122 is pivotably attached to mounting bracket 123 found on the frame assembly. The screw members are pivotably attached at one end to the tension arm 122 and at a second end to mounting bracket 123 on rail 116 by use of turnbuckle brackets 124. Turning of the turnbuckle will cause tension arm 122 to move about its pivot point and exert more or less tension on conveyor chain 110 as needed.

Figure 7:
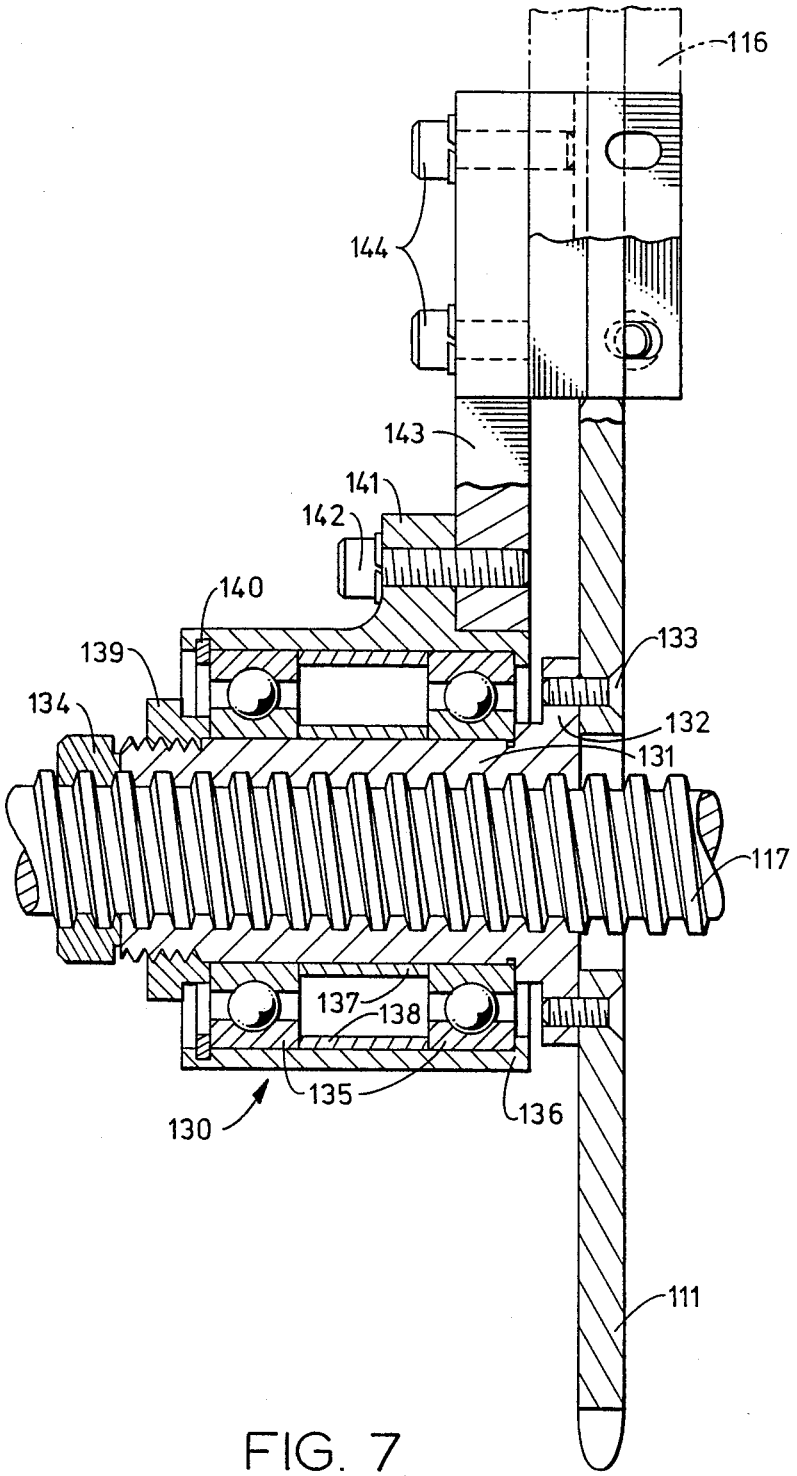
FIG. 7 is a top view partially in section showing a lateral adjusting means used as a part of an auxiliary chain drive system in the apparatus of FIG. 2.
Figure 8:
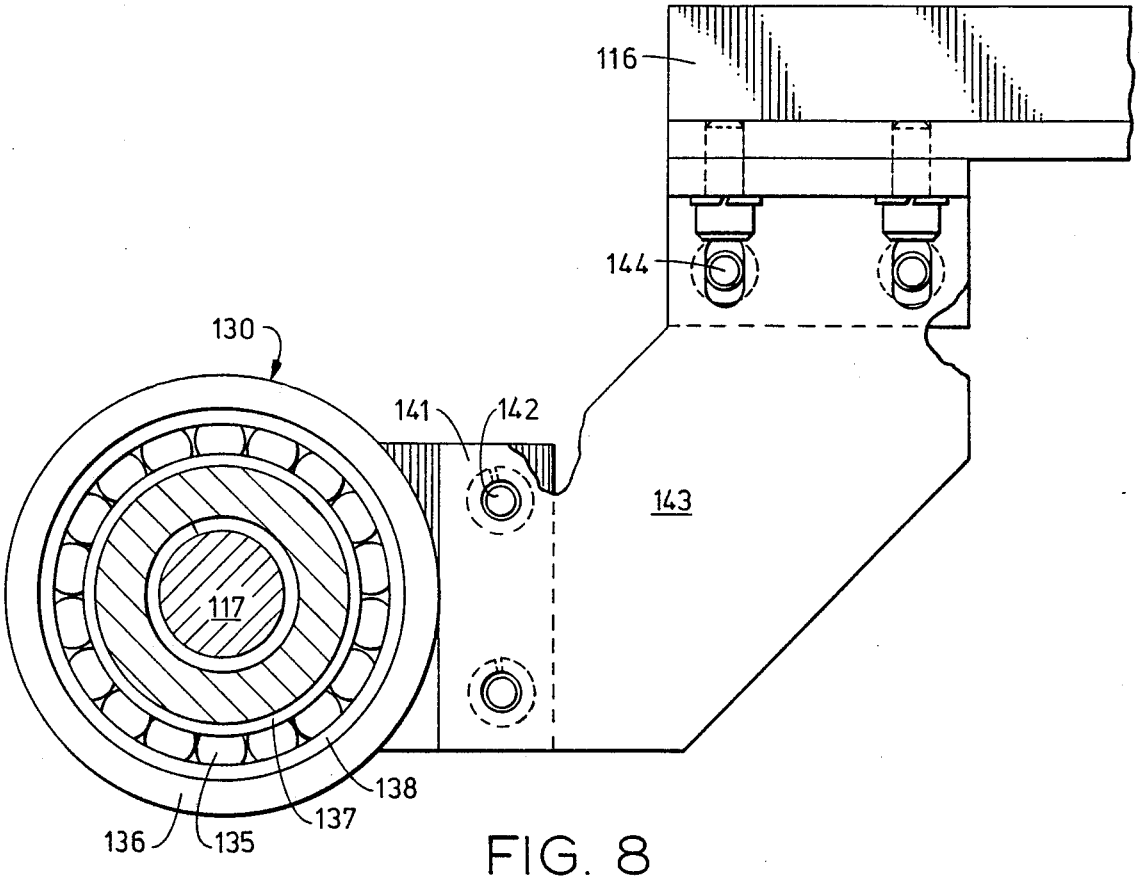
FIG. 8 is a front view partially in section of the lateral adjusting means of FIG. 7.
Figure 9:
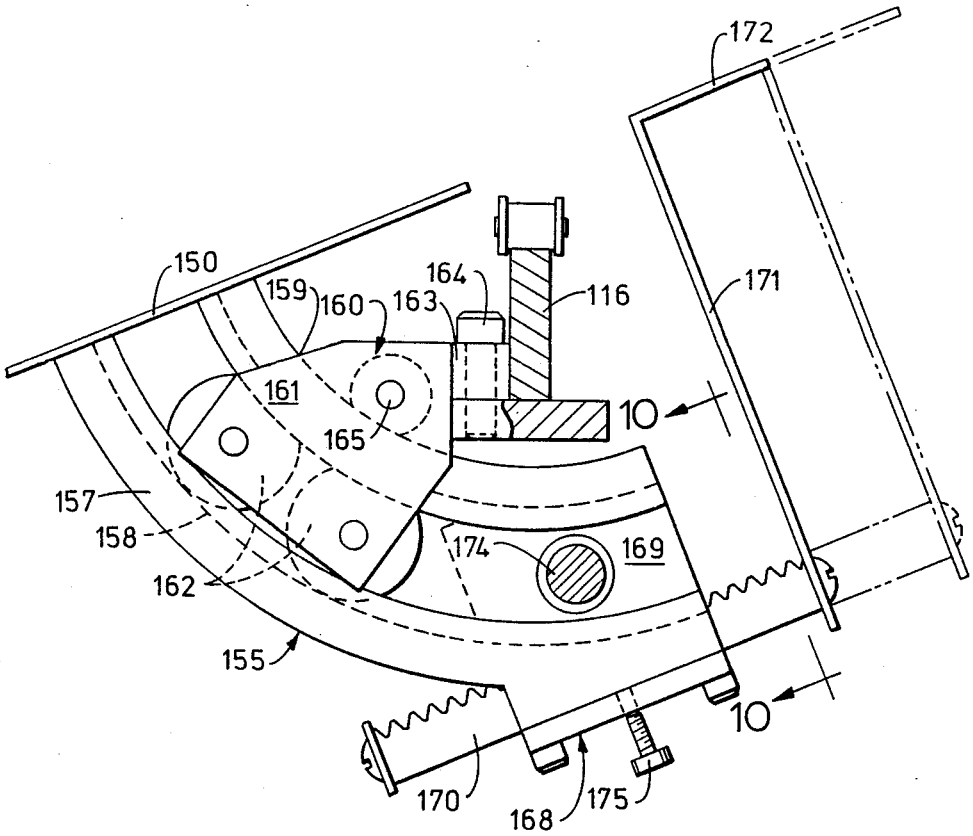
FIG. 9 is a side view partially in section of a raceway adjusting mechanism used on the on-line tipping apparatus of FIG. 2.
Figure 10:
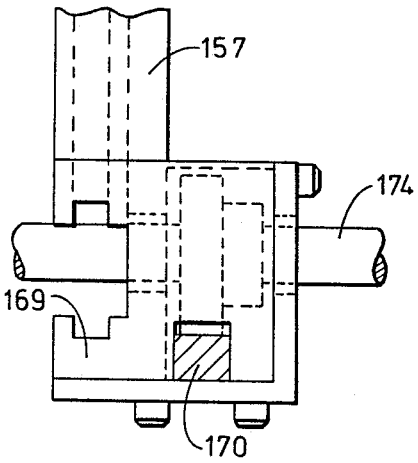
FIG. 10 is an end view of the adjusting mechanism of FIG. 9 taken along line 10—10.
Figure 11:
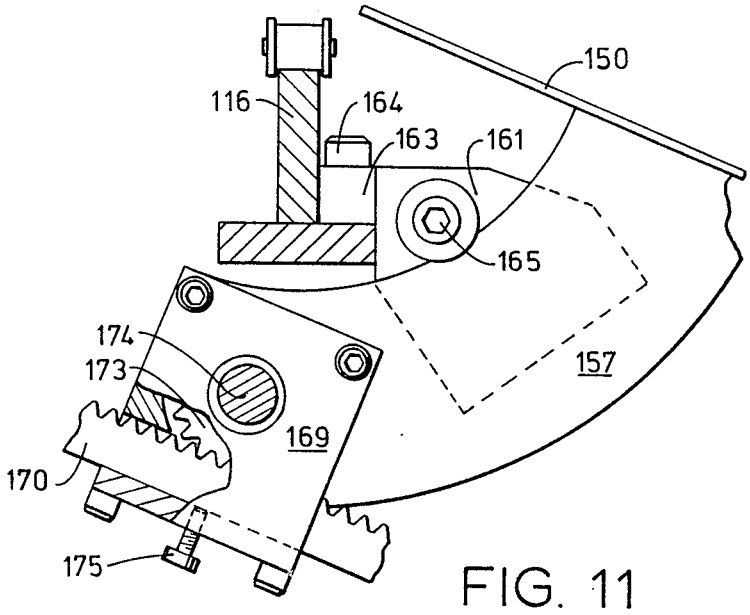
FIG. 11 is another side view partially in section and with a partial cut-away of the raceway adjusting mechanism of FIG. 9.

The auxiliary conveyor chain assembly is capable of lateral movement. As best seen in FIGS. 3, 7 and 8, sprocket wheel 111 is mounted on threaded shaft 117 in a fashion which allows it to laterally move on said shaft. An auxiliary drive hub assembly 130 is positioned on shaft 117 by use of a threaded hub 131. The hub is provided with a flange 132 at an end adjacent sprocket wheel 111. Flange 132 has a series of spaced threaded screw holes around its periphery to provide a means by which it is fixedly attached to sprocket wheel 111. The hub and sprocket wheel are held together for revolving motion with shaft 117 by screws 133. The internal thread of the hub cooperates with the external thread of shaft 117 to provide longitudinal displacement of hub 131 and sprocket wheel 111 upon shaft 117 when the shaft is held stationary and sprocket wheel 111 is turned. A lock nut 134 is used to lock threaded hub 131 upon shaft 117 so that both rotate in unison.

A pair of ball bearings 135 is used to rotably mount the threaded hub 131 is a bearing housing 136. Each member of the pair of ball bearings 135 is held in a fixed spaced relationship within the assembly by hub spacer 136 and housing spacer 137. The ball bearings are held upon the hub 131 by means of a jam nut 139. A retaining ring 140 retains the bearing housing 136 upon the ball bearings 135, said ring being mounted in a groove cut into the inside diameter of the bearing housing 136.

The bearing housing 136 has an ear flange 141 extending from one side. Cap screws 142 passing through the ear flange are used to fixedly secure the bearing housing 136 to a support bracket 143 which in turn is attached to rail 116 by screw 144. The ball bearings 135 allow the hub 131 and sprocket wheel 111 to rotate with threaded shaft 117 during normal operation while the bearing housing 136 is stationary.

If lateral adjustment of the auxiliary chain drive system is needed, lock nut 134 is loosened and sprocket wheel 111 and hub assembly 130 moved along the threaded shaft 117 to a desired position. Sprocket wheel 112 at the other end of the platform is similarly mounted and independently moved in the same fashion.

A set of pusher pins 145 are provided on the auxiliary conveyor drive chain for the purpose of engaging the signatures and inserts and driving them along. The adjusting mechanisms of the apparatus allow the pusher pins 145 of the auxiliary conveyor drive chain and the pusher pins 14 of the main conveyor drive chain to simultaneously engage a signature. The pusher pins can be removed and mounted at each chain link. Adjustment of pusher pin placements on the auxiliary conveyor chain gives the needed compatibility with pusher pins 14 on the main conveyor chain. As a result a properly positioned insert is added to the signature.

A raceway 150 is also positioned on the frame assembly. The raceway preferably extends substantially the length of the on-line tipping apparatus. The raceway serves the function of receiving a half-section of a booklet and providing a flattened surface on which it can travel while receiving a bead of adhesive and an insert. The raceway is adjustably mounted on rail 116 to tilt to accommodate various inserts and signatures of different sizes and weights. Thus, raceway 150 is mounted above drive system base 52 by means of adjusting mechanisms best seen in FIGS. 9–11. Raceway adjusting mechanisms 155 are positioned in the approximate center of the raceway and near each end. Each mechanism has a slide pinion housing 157 with curved rails 158 and 159. Housing 157 is secured to the underside of the elongated raceway 150. A roller unit 160 comprised of housing 161 and rollers 162 are positioned on rails 158 and 159, respectively. The roller unit is fixedly mounted on rail 116 by use of a bracket 163 and cap screw 164. A set screw lock 165 extends in frictional engagement through the housing 161 of each tray adjusting mechanism to lock the mechanisms in place once properly adjusted. In accord with this invention, the raceway can be tilted up to about sixty degrees from the horizontal.

Also associated with the raceway adjusting mechanisms is a rack unit 168 comprised of housing 169, modified rack 170 with a bracket 171, and a raceway extension 172 secured thereto. The modified rack works in association with gear wheel 173 mounted on rod 174 to move the raceway extension so as to lengthen or shorten the raceway's working surface as needed. Rod 174 extends between all three tray adjusting mechanisms to simultaneously adjust all raceway extensions. A lock mechanism 175 locks the raceway extensions to a desired position. This feature is especially useful with large signatures in that it provides a wider flattened surface on which the booklet half-sections ride.

A mounting bar 180 is used to hold the adhesive applying mechanisms. Thus, an electric eye sensor 181 and a solenoid glue gun 23 are positioned above elongated raceway 150 and prior to insert hopper 28. The sensor and glue gun are part of a conventional adhesive means. Control box 26 and hot melt reservoir 25 shown in FIG. 1 together with the sensor and glue gun properly apply a bead of adhesive to a signature. Placement and amount of adhesive are done under controlled conditions in a known fashion. As seen in FIG. 3, a timing compensator mechanism 182 is operably connected to shaft 117 and the control box 26. Such timing compensator mechanisms are well known and commercially available. A glue hold down assembly comprised of a roller 183 adjustably mounted on the mounting bar 180 is positioned above the conveyor chain 13 and after the insert hopper 28. Its function is to force the insert into contact with the adhesive bead found on the signature. While not shown, various sensing devices can be provided to disengage the roller 183 if an insert is not present.

An elongated catch saddle 190 in the form of a right angle rail is positioned above the raceway by means of arm 191 and bracket 192 secured to mounting bar 180. The elongated catch saddle 190 together with an optional second elongated catch saddle 193 also extending from arm 191 receive an insert from a hopper and retains it in place until picked up by the pins of the conveyor chains and moved along. In accord with this invention pusher pins 14 and 145 on the conveyor chains of the main chain drive system and the auxiliary chain drive system simultaneously move the signature, with overlying insert, along the raceway.

In operation, the on-line tipping apparatus is moved into engagement with a signature inserting machine. The auxiliary chain drive system is approximately positioned by adjusting its height from the floor surface by use of the scissor lifter means. Thereafter, the turn screw adjusting mechanism is used to further position the take-off sprocket wheel of the auxiliary chain drive system into engagement with the signature inserting machine's main conveyor chain. The slide block synchronization assembly is used to advance the auxiliary conveyor chain a fraction of a link if needed. The pins on the two conveyor chains are repositioned on the chains if needed to make them compatible when running. Next, the raceway of the apparatus is adjusted in its tilt and width depending on the particular signature and insert to be added thereto. If needed, the auxiliary conveyor chain is laterally moved. All locking mechanisms are tightened once all features of the tipping apparatus are positioned for operation. Supplying power to the signature inserting machine runs its main conveyor chain and simultaneously the auxiliary conveyor chain drive system. Each conveyor chain moves at the same speed with their pusher pins in alignment. Signatures move along the main conveyor chain until they reach the raceway. There, a half-section of the booklet is opened onto the raceway in a flattened state. A bead of adhesive is applied to it and subsequently an insert held above the raceway by the elongated catch saddles is caught by a pusher pin and dropped onto the adhesive bead. Subsequent signatures are added until the end of the machine reached wherein the assembled signatures with insert are bound.

It should be apparent the apparatus of this invention enjoys many advantages. The portable nature of the apparatus allows it to be used as needed. The apparatus is simply moved from storage to a conventional signature inserting machine when inserts are to be added. Separate signature inserting machines with built-in insert capability or tipping apparatus which are run independently are no longer needed. The adjusting mechanisms built into the on-line tipping apparatus of this invention allow it to be used with several makes and models of conventional signature inserting machines. The drive system tipping apparatus is fully compatible with the main conveyor chain of the inserting machine because of the fact it is driven by the main conveyor chain. Thus, the speed and timing of the auxiliary conveyor chain of the tipping apparatus is directly controlled by the main conveyor chain of the inserting machine. This allows use of the tipping apparatus as discussed without a need to change the sprocket wheels of the main conveyor chain to compatibilize the chain speeds. In effect the tipping apparatus when properly adjusted is self-timed. Adjustability of pin spacing on the respective auxiliary conveyor chain and main conveyor chain also adds to the compatibility of the apparatus. The result of the aforementioned features is that inserts of varied sizes are properly positioned on a signature with no loss of machine speed.

While the invention has been described with particular reference to the drawings, it should be understood various modifications of an obvious nature can be made. For example, corner screw lifting means can be used to adjust the height of the platform. Adhesive applicators of various designs for hot melt and cold adhesives can also be used as well as various sensing devices and automatic stopping devices. The raceway, adhesive applying mechanism and elongated catch saddle can individually or collectively be mounted on the signature inserting machine in operable association with the tipping apparatus. Specially constructed floor stands can as well be used to hold the aforesaid components in position with the tipping apparatus to perform their respective functions. Such modifications are intended to be within the scope the claimed invention.

What is claimed is:

1. A portable on-line tipping apparatus intended for use with a signature inserting machine wherein the apparatus has an auxiliary chain drive system run by a main conveyor chain drive system of the signature inserting machine, said on-line tipping apparatus comprising:

(a) a frame assembly capable of being readily moved from a place of storage to operable association with the signature inserting machine;

(b) a drive system base mounted on the frame assembly for accommodating an auxiliary chain drive system, said base having a vertical movement means for approximate positioning of the auxiliary chain drive system;

(c) an auxiliary chain drive system mounted on the drive system base said auxiliary chain drive system having an endless auxiliary conveyor chain with pusher means thereon for moving an insert along its length, said system having means to operably engage it with the main conveyor chain whereby power from said main conveyor chain is transferred to the auxiliary conveyor chain so as to directly control its speed and timing;

(d) a raceway operably associated with the frame assembly above the auxiliary chain drive system for receiving a signature from the signature inserting machine;

(e) an adhesive applying mechanism operably associated with the frame assembly for directing a bead of adhesive to an outwardly facing surface of the signature while being moved by the pusher means of the endless auxiliary conveyor chain; and (f) an elongated catch saddle operably associated with the frame assembly and above the raceway for receiving an insert from a hopper of the signature inserting machine, said elongated catch saddle adjustably positioned to receive the insert so as to overlie the adhesive bead on the signature.

2. The apparatus of claim 1 wherein the adhesive applying mechanism is normally operable to apply a quantity of adhesive to a signature in timed response to an advancing signature and sheet-detecting means located on the frame assembly in advance of the adhesive applying mechanism for rendering said mechanism inoperative in the absence of a signature.

3. The apparatus of claim 2 further comprising means positioned on the frame assembly to apply pressure to the insert after it has been moved into contact with the signature page.

4. The apparatus of claim 3 wherein the means to apply pressure is a roller positioned on the frame assembly so as to apply pressure onto the insert directly above the adhesive bead.

5. The apparatus of claim 1 wherein the raceway is capable of receiving a half-section of a booklet in a substantially flattened state with a second half-section extending therefrom at an about right angle.

6. The apparatus of claim 1 further comprising a second elongated catch saddle positioned on the frame assembly and above the raceway to act in conjunction with the first elongated catch saddle to hold an insert.

7. The apparatus of claim 1 wherein the auxiliary chain drive system includes a power take-off sprocket wheel for engaging an endless main conveyor chain of the signature inserting machine and means to transfer movement therefrom to the endless auxiliary conveyor chain.

8. The apparatus of claim 7 wherein an endless power transfer chain conveys the movement from the power take-off sprocket wheel and adjusting means are associated with the power take-off sprocket wheel to vertically change its position to properly engage the main conveyor chain.

9. The apparatus of claim 8 wherein the power take-off sprocket wheel is mounted on a pivot arm which is pivotably engaged at a second extremity to allow the sprocket wheel to move vertically.

10. The apparatus of claim 9 further comprising a slide block synchronization assembly operably associated with the endless power transfer chain to synchronize chain speed with the main conveyor chain.

11. The apparatus of claim 1 wherein the auxiliary chain drive system further has means to laterally adjust its endless conveyor chain relative to the endless conveyor chain of the main chain drive system.

12. The apparatus of claim 11 wherein each sprocket wheel of the auxiliary chain drive system is mounted on a threaded shaft and further wherein a drive hub assembly attached to the sprocket wheel is capable during operation of maintaining the sprocket wheel in one position yet when not in operation will allow the sprocket wheel to move laterally along the threaded shaft.

13. The apparatus of claim 12 wherein the drive hub assembly comprises a threaded hub positioned on the shaft and secured to the sprocket wheel, a roller bearing unit mounted on the threaded hub and a bearing housing secured to a rail which extends along the endless auxiliary conveyor chain wherein the roller bearing unit allows the threaded hub and sprocket wheel to rotate with the shaft while holding the bearing housing in a stationary position.

14. The apparatus of claim 1 wherein the vertical movement means for the platform is a set of scissor lifter means.

15. The apparatus of claim 14 wherein the drive system base and frame assembly are generally rectangular in shape and a set of scissor lifter bars are operably associated with each corner and further wherein the sets of lifter bars are connected together to exert a raising or lowering force to the base in substantial concert.

16. The apparatus of claim 1 wherein raceway adjusting mechanisms are positioned on the raceway to change the tilt of the raceway so as to accommodate various signature sizes and weights.

17. The apparatus of claim 16 further wherein the raceway has a raceway extension means associated with the raceway adjusting means.

18. The apparatus of claim 1 wherein the elongated catch saddle is a right angle rail extending substantially the length of the raceway.

19. In a signature inserting machine for applying inserts to signatures intended for assembly into booklets wherein the machine has a signature conveyor arranged to carry individual signatures along a predetermined path with the backbone edge of the signatures all in the same alignment, supply means for inserts to be attached to said signatures, means for feeding the inserts singularly from said supply means each in a predetermined alignment, wherein the improvement comprises the positioning of an on-line tipper apparatus in operable association with the signature inserting machine, said apparatus comprising:

(a) a frame assembly;

(b) a drive system base mounted on the frame assembly for accommodating an auxiliary chain drive system said base having a vertical movement means for approximate positioning of the auxiliary chain drive system;

(c) an auxiliary chain drive system mounted on the drive system base said auxiliary chain drive system having an endless auxiliary conveyor chain with pusher means thereon for moving an insert along its length, said system having means to operably engage it with a main conveyor chain of the signature inserting machine whereby power from said main conveyor chain is transferred to the auxiliary conveyor chain so as to directly control its speed and timing;

(d) a raceway operably associated with the frame assembly above the auxiliary chain drive system for receiving a signature from the signature inserting machine;

(e) an adhesive applying mechanism operably associated with the frame assembly for directing a bead of adhesive to an outwardly facing surface of the signature while being moved by the pusher ;means of the auxiliary conveyor chain; and (f) an elongated catch saddle operably associated with the frame assembly and above the raceway for receiving an insert from a hopper of the signature inserting machine, said elongated catch saddle adjustable positioned to receive the insert so as to overlie the adhesive bead on the signature.

* * * * *